US011571105B2

(12) United States Patent
Baydoun et al.

(10) Patent No.: US 11,571,105 B2
(45) Date of Patent: Feb. 7, 2023

(54) SPOT DETECTION ASSEMBLY FOR A DISHWASHER APPLIANCE

(71) Applicant: Haier US Appliance Solutions, Inc., Wilmington, DE (US)

(72) Inventors: Habib Baydoun, Dearborn Heights, MI (US); Ramasamy Thiyagarajan, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 101 days.

(21) Appl. No.: 17/102,655

(22) Filed: Nov. 24, 2020

(65) Prior Publication Data

US 2022/0160204 A1 May 26, 2022

(51) Int. Cl.

| | |
|---|---|
| ***A47L 15/42*** | (2006.01) |
| ***A47L 15/46*** | (2006.01) |
| ***A47L 15/00*** | (2006.01) |

(52) U.S. Cl.

CPC ..... *A47L 15/4295* (2013.01); *A47L 15/46* (2013.01); *A47L 15/0026* (2013.01); *A47L 15/0028* (2013.01); *A47L 15/0034* (2013.01); *A47L 2401/04* (2013.01)

(58) Field of Classification Search

None

See application file for complete search history.

(56) References Cited

U.S. PATENT DOCUMENTS

| | | | |
|---|---|---|---|
| 9,999,340 | B2 | 6/2018 | DeWeerd et al. |
| 2017/0127905 | A1 | 5/2017 | DeWeerd et al. |
| 2017/0202426 | A1 | 7/2017 | Bosen et al. |
| 2019/0244375 | A1 | 8/2019 | Choi et al. |

FOREIGN PATENT DOCUMENTS

| | | | |
|---|---|---|---|
| EP | 3205764 | B1 | 3/2019 |
| JP | 2003/235781 | A | 8/2003 |
| WO | WO2020/125458 | A1 | 6/2020 |
| WO | WO2020/144127 | A1 | 7/2020 |

*Primary Examiner* — Rita P Adhlakha

(74) *Attorney, Agent, or Firm* — Dority & Manning, P.A.

(57) ABSTRACT

A dishwasher appliance includes a cabinet having a wash chamber for receipt of articles for cleaning, a rack assembly slidably received into the wash chamber and configured for the receipt of the articles, and a fluid dispensing assembly for dispensing a fluid onto the articles in the rack assembly during operation of the dishwasher appliance. Further, the dishwasher appliance includes a spot detection assembly. The spot detection assembly includes a transparent component and an imaging device arranged adjacent to the transparent component. As such, the imaging device is configured to detect one or more fluid spots on the transparent component, which is indicative of fluid spots being present on the articles.

12 Claims, 5 Drawing Sheets

SPOT DETECTION ASSEMBLY FOR A DISHWASHER APPLIANCE

FIELD OF THE INVENTION

The present subject matter relates generally to dishwasher appliances, and more particularly to a spot detection assembly for a dishwasher appliance.

BACKGROUND OF THE INVENTION

Dishwasher appliances clean dishes disposed therein using a washing fluid (e.g., water and detergent) to remove debris and stains from the dishes. Thereafter, the dishes are rinsed with water to remove the washing fluid. After rinsing, the dishes can be dried by the dishwasher appliance, e.g., to avoid streaking or spotting on the dishes. Conventionally, certain dishwasher appliances use a heating element (e.g., an electric resistance element) to dry the dishes after rinsing. In addition, such dishwasher appliances are vented to allow steam and humid air to escape the appliance during drying.

At the end of the drying cycle, however, dishes may be left with undesirable water spots, leaving the dishes with an unclean appearance. In such instances, the dishes must be rewashed, often by hand, to remove such spots. Furthermore, current dishwasher appliances lack the ability to detect the formation of these spots on the dishes following a wash cycle. In particular, the disordered nature of how the dishwasher appliance is loaded with the dishes, as well as the varying types of dishes loaded therein may it difficult for spot detection.

Accordingly, a dishwasher appliance that includes a spot detection assembly would be useful. Thus, the present disclosure is directed to a dishwasher appliance having a spot detection assembly, wherein, when spots are identified, one or more spot mitigating algorithms may be employed.

BRIEF DESCRIPTION OF THE INVENTION

Aspects and advantages of the invention will be set forth in part in the following description, or may be obvious from the description, or may be learned through practice of the invention.

In an aspect, the present disclosure is directed to a dishwasher appliance. The dishwasher appliance includes a cabinet having a wash chamber for receipt of articles for cleaning, a rack assembly slidably received into the wash chamber and configured for the receipt of the articles, and a fluid dispensing assembly for dispensing a fluid onto the articles in the rack assembly during operation of the dishwasher appliance. Further, the dishwasher appliance includes a spot detection assembly. The spot detection assembly includes a transparent component and an imaging device arranged adjacent to the transparent component. As such, the imaging device is configured to detect one or more fluid spots on the transparent component, which is indicative of fluid spots being present on the articles.

In another aspect, the present disclosure is directed to a method for reducing or eliminating fluid spots on articles in a dishwasher appliance. The method includes initiating a cleaning cycle for the dishwasher appliance. Further, the method includes activating a spot detection assembly having a transparent component and an imaging device arranged adjacent to the transparent component. Moreover, the method includes determining, via the spot detection assembly, whether one or more fluid spots are present on the transparent component. If the fluid spot(s) are present on the transparent component, which is indicative of similar fluid spots being present on the articles, the method includes implementing a spot mitigation algorithm. Alternatively, if the fluid spot(s) are not present on the transparent component, the method includes implementing a closing sequence to the cleaning cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
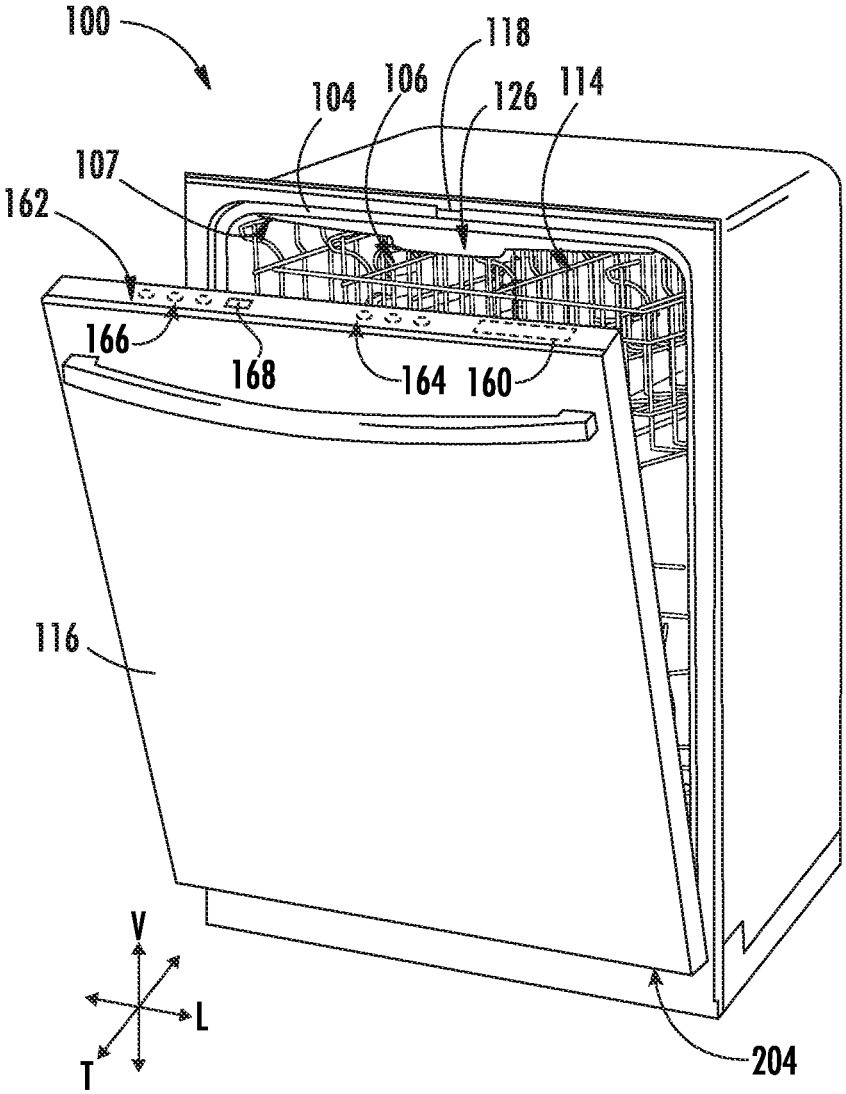
FIG. 1 provides a perspective view of a dishwasher appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Generally, the present disclosure is directed to a spot detection assembly for a dishwasher appliance that eliminates complications introduced by the disordered nature of how the appliance is loaded and the types of articles loaded therein. In particular, the spot detection assembly introduces a proxy dishwasher load in the form of a transparent component, such as a sheet of glass adjacent to an imaging device. The imaging device uses image recognition algorithms to detect spots on the transparent component. If spots are detected, then it can be assumed that spots are also present on the surface of the dishwasher load.

Figure 2:
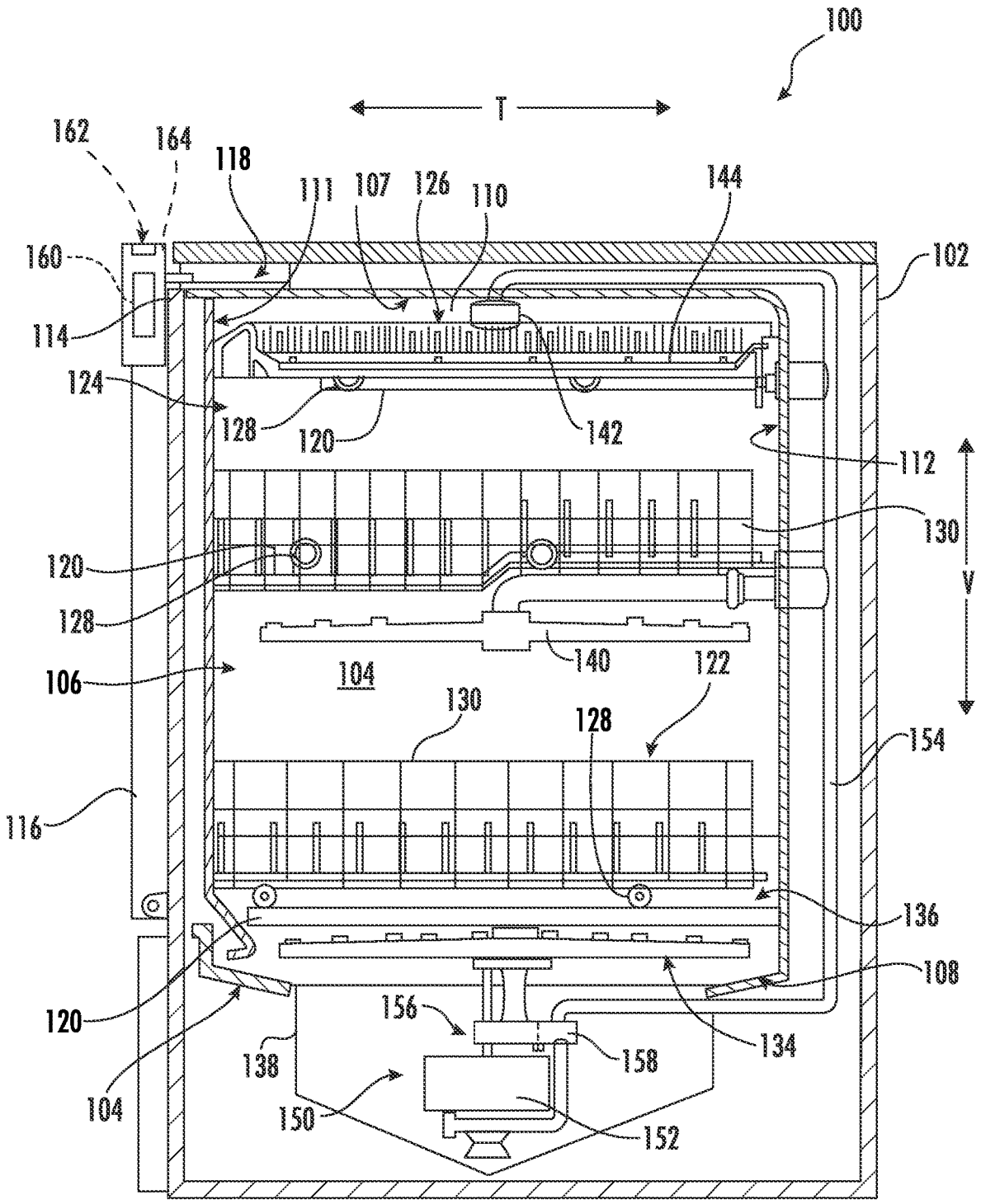
FIG. 2 provides a cross-sectional side view of the exemplary dishwasher appliance of FIG. 1.

Accordingly, the spot detection assembly can reduce the need for the use of rinse aid detergents within the dishwasher appliance. For example, if no spots are detected, then the algorithm can be modified to not release any rinse aid that is stored within the dishwasher appliance. Moreover, in an embodiment, the spot detection assembly may be included in the door of the dishwasher appliance, e.g. as part of the detergent release mechanism, which does not require any modifications to the dishwasher appliance Referring now to the figures, FIGS. 1 and 2 depict an exemplary domestic dishwasher or dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher appliance 100. According to exemplary embodiments, the dishwasher appliance 100 further includes a door closure mechanism or assembly 118 that is used to lock and unlock the door 116 for accessing and sealing the wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, the upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

The dishwasher appliance 100 further includes a fluid dispensing assembly, such as a plurality of spray assemblies for urging a flow of water or wash fluid onto the articles placed within wash chamber 106. More specifically, as illustrated in FIG. 2, the dishwasher appliance 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, the upper spray assembly 142 may be configured for urging or cascading a flow of wash fluid downward over rack assemblies 122, 124, and 126. As further illustrated in FIG. 2, the upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, the fluid circulation assembly 150 includes a pump 152 for circulating water or wash fluid (e.g., detergent, water, or rinse aid) in the tub 104. The pump 152 may be located within sump 138 or within a machinery compartment located below sump 138 of tub 104, as generally recognized in the art. Further, the fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, the primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, the spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, the dishwasher appliance 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, the pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

The dishwasher appliance 100 is further equipped with a controller 160 to regulate operation of the dishwasher appliance 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher appliance 100. In the illustrated embodiment, the controller 160 may be located within a control panel area 162 of the door 116, as shown in FIGS. 1 and 2. In such an embodiment, input/output ("I/O") signals may be routed between the control system and various operational components of the dishwasher appliance 100 along wiring harnesses that may be routed through the bottom of door 116. Typically, the controller 160 includes a user interface panel 164 through which a user may select various operational features and modes and monitor progress of the dishwasher appliance 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

Figure 3:
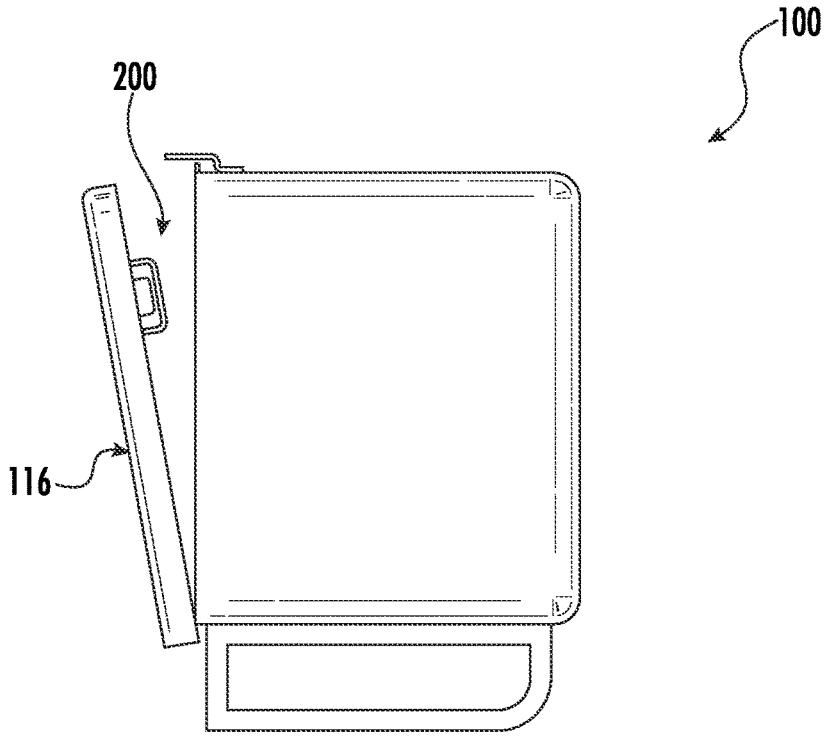
FIG. 3 provides a side view of a dishwasher appliance according to exemplary embodiments of the present disclosure, particularly illustrating a spot detection assembly positioned on an inner surface of a door of the dishwasher appliance.
Figure 4:
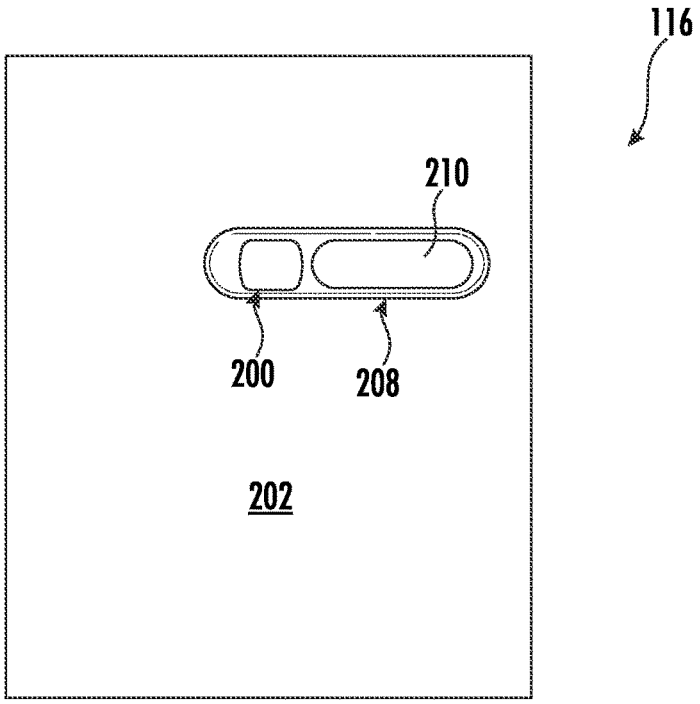
FIG. 4 provides an interior view of the inner surface of the door of the dishwasher appliance of FIG. 3, particularly illustrating the spot detection assembly.

Referring now generally to FIGS. 3 and 4, various views of the dishwasher appliance 100 are provided to illustrate a spot detection assembly 200 according to the present disclosure. In particular, FIG. 3 illustrates a side view of the dishwasher appliance 100 according to exemplary embodiments of the present subject matter, particularly illustrating the door 116 of the dishwasher appliance 100 in a partially-opened position to illustrate the spot detection assembly 200. FIG. 4 illustrates an interior view of the door 116 of the dishwasher appliance 100 according to exemplary embodiments of the present subject matter, which also illustrates an example location of the spot detection assembly 200. In particular, as shown, the spot detection assembly 200 may be secured to an interior surface 202 of the door 116. More specifically, as shown in FIG. 4, the spot detection assembly 200 may be arranged in a door cavity 208, e.g. adjacent to a detergent storage compartment 210 in the door 116 of the dishwasher appliance 100.

Figure 5:
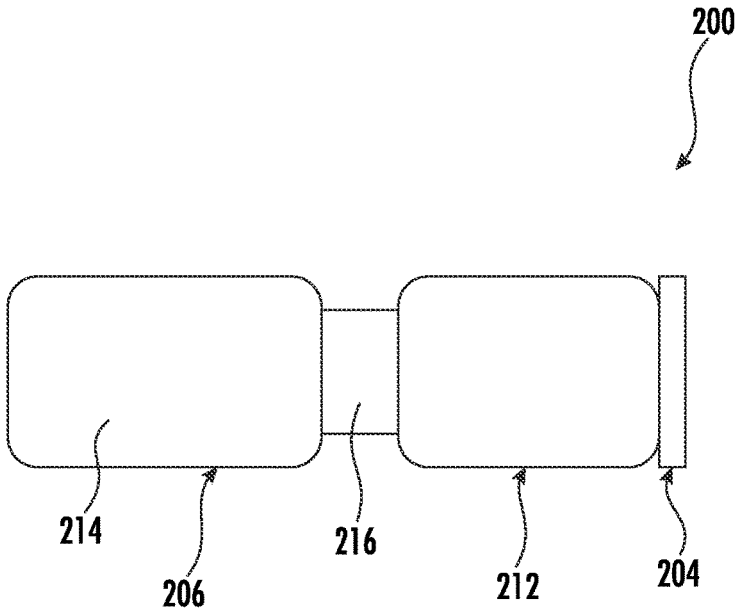
FIG. 5 provides a schematic view of a spot detection assembly for a dishwasher appliance according to exemplary embodiments of the present disclosure.

Referring now to FIG. 5, the spot detection assembly 200 described herein includes a transparent component 204 and an imaging device 206 arranged adjacent to the transparent component 204. As such, the imaging device 206 is configured to detect one or more fluid spots on the transparent component 204, which is indicative of fluid spots being present on the articles (e.g. water spots on dishes).

More specifically, as shown, the transparent component 204 is constructed of a transparent material, such as a glass material, a polymer material, or any another transparent or semi-transparent material. For example, as shown in FIG. 4, the transparent component 204 is a flat or linear piece of glass. In alternative embodiments, the transparent component 204 may have an arcuate configuration. In such embodiments, the transparent component 204 may be curved (e.g. concave or convex) or tubular. Accordingly, the transparent component 204 is configured to act as a proxy of a dishwasher load in that, if the articles within the cabinet of a given wash cycle have spots, then the transparent component 204 will also have water spots after the wash cycle.

Moreover, in an embodiment, the imaging device 206 may be any suitable image sensor or camera device capable of capturing one or more visual images of the transparent component 204. For example, as shown in FIG. 5, the imaging device 206 corresponds to a camera sensor 214 having a camera lens 216. In addition, and still referring to FIG. 5, the spot detection assembly 200 may also include one or more optional spacers 212 positioned between the transparent component 204 and the imaging device 206. In such embodiments, the spacer(s) 212 are also constructed of any suitable transparent material, such as those described herein with respect to the transparent component 204. Thus, the imaging device 206 is capable of capturing images of the transparent component 204 through the spacer(s) 212.

In still another embodiment, the controller 160 described herein may be communicatively coupled to the imaging device 206, such as information used to generate an image of the transparent component 204. Thus, in certain embodiments, the controller 160 may include at least one algorithm programmed therein that can receive an indication from the imaging device 206 of whether fluid spots are detected on the transparent component 204 or whether the transparent component 204 is spotless.

Figure 6:
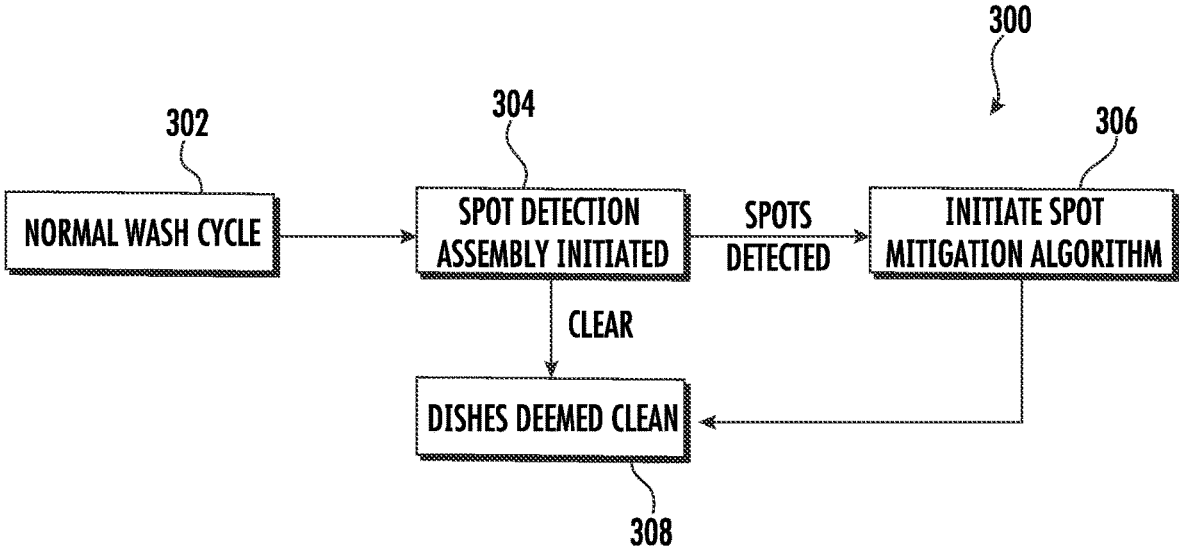
FIG. 6 provides a flow diagram of a simplified algorithm for reducing or eliminating fluid spots on articles in a dishwasher appliance according to exemplary embodiments of the present disclosure.

For example, referring now to FIG. 6, a simplified algorithm 300 that may be implemented by the controller 106 is illustrated. As shown, the algorithm 300 starts at 302 by initiating a normal or standard wash cycle. As shown at 304, the spot detection assembly 200 is initiated. As shown at 306, if spots are detected on the transparent component 204 by the imaging device 206, then the algorithm 300 is configured to initiate one or more spot mitigation algorithms. If, however, spots are not detected, as shown at 308, the algorithm 300 indicates that the articles (e.g. dishes) are clean.

Figure 7:
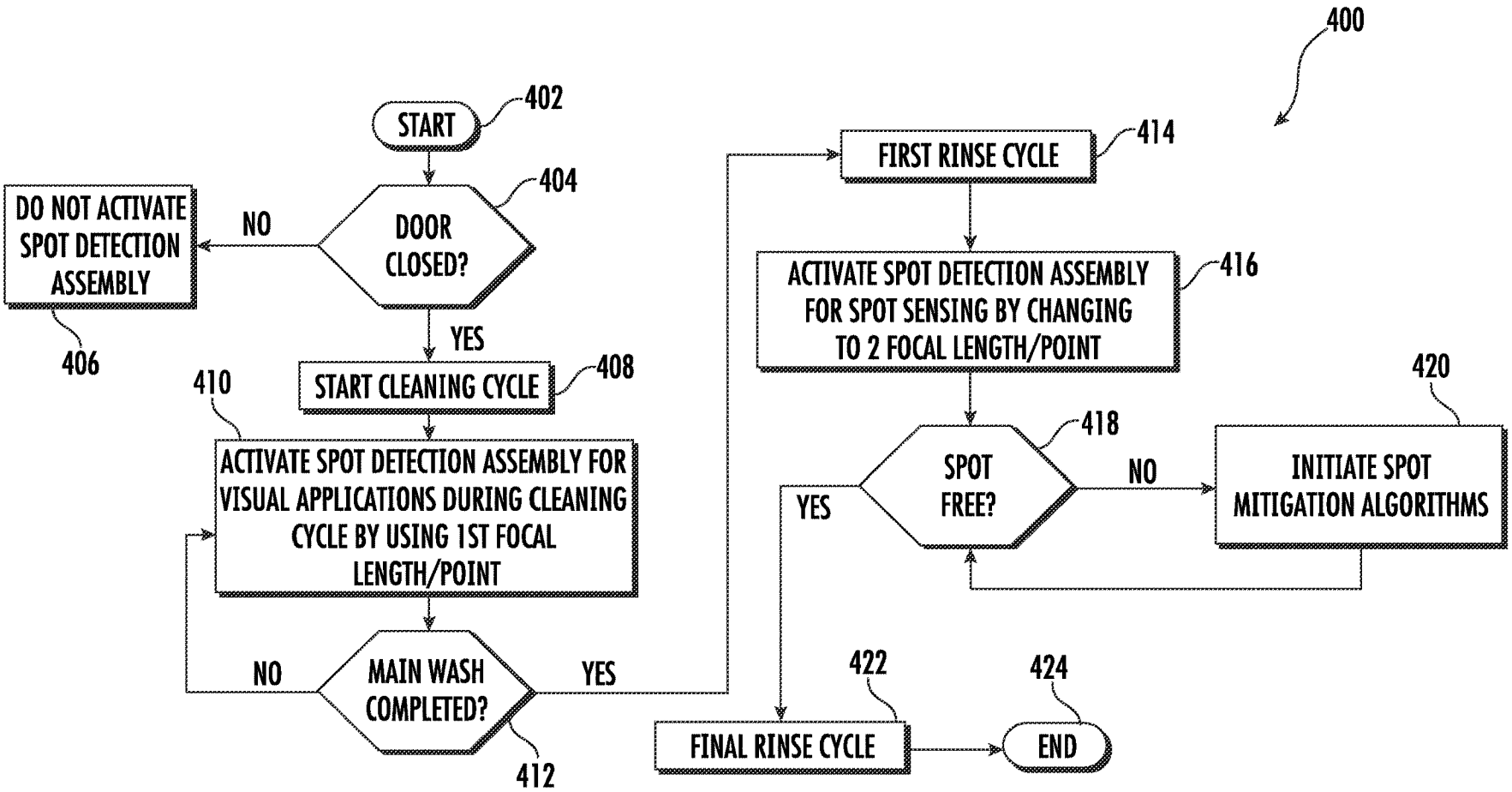
FIG. 7 provides a flow diagram of another algorithm for reducing or eliminating fluid spots on articles in a dishwasher appliance according to exemplary embodiments of the present disclosure.

Referring now to FIG. 7, a more detailed algorithm 400 that may be implemented by the controller 160 is illustrated. As shown at 402, the algorithm 400 begins. As shown at 404, the algorithm 400 ensures that the door 116 is secured in a closed position. If not, as shown at 406, the spot detection assembly 200 is not activated. If the door 116 is closed, then the algorithm 400 proceeds with initiating a cleaning cycle as shown at 408. As shown at 410, the algorithm 400 then activates the spot detection assembly 200 for visual applications during the cleaning cycle, e.g. by using a first focal length/point. As shown at 412, the algorithm 400 determined whether a main wash cycle of the cleaning cycle is complete. If not, the algorithm 400 returns to 410. If the main wash cycle is complete, then the algorithm 400 initiates a first rinse cycle as shown at 414. As shown at 416, the algorithm 400 activates the spot detection assembly 200 for spot sensing by changing to a second focal length/point.

As shown at 418, the algorithm 400 determines whether the articles contain water spots. For example, in an embodiment, the algorithm may receive information collected by the imaging device 206 using the first and second focal points and may determine whether fluid spots are present on the transparent component 204 based on the information. Thus, by determining whether the transparent component 204 contains water spots, the algorithm 400 can infer whether the articles in the cabinet 102 contain similar spots as spots on the transparent component 204 is indicative of such spots also being present on the articles.

If the articles are inferred to contain spots, as shown at 418, the algorithm 400 initiates one or more spot mitigation algorithms. For example, in an embodiment, when the indication from the imaging device 206 indicates one or more fluid spots are detected on the transparent component 204, the algorithm 400 is configured to implement a control action to reduce or eliminate the fluid spots. In such embodiments, the control action may include, for example, a rinse cycle, a wash cycle, a drying cycle, a heating cycle, a draining cycle, a filtering cycle, a drying cycle, or combinations thereof.

In contrast, as shown at 422, when the indication from the imaging device 206 indicates the transparent component 204 is spotless, the algorithm 400 may be configured to implement a closing sequence for the cleaning cycle, such as ending the cleaning cycle, preventing a rinse aid from being released, or implementing a final rinse cycle. For example, in the illustrated embodiment, the final rinse cycle may be initiated. Further, the algorithm 400 ends as shown at 424.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a cabinet having a wash chamber for receipt of articles for cleaning;

a rack assembly slidably received into the wash chamber and configured for the receipt of the articles;

a fluid dispensing assembly for dispensing a fluid onto the articles in the rack assembly during operation of the dishwasher appliance;

a spot detection assembly, comprising:

a transparent component;

an imaging device arranged adjacent to the transparent component, the imaging device configured to detect one or more fluid spots on the transparent component, wherein the one or more fluid spots being present on the transparent component is indicative of similar fluid spots being present on the articles.

2. The dishwasher appliance of claim 1, wherein the cabinet is selectively accessible via a door, and wherein the spot detection assembly is secured to an interior surface of the door.

3. The dishwasher appliance of claim 2, wherein the spot detection assembly is arranged adjacent to a detergent storage compartment in the door.

4. The dishwasher appliance of claim 1, wherein the transparent component is constructed of a transparent material.

5. The dishwasher appliance of claim 4, wherein the transparent material comprises at least one of a glass material or a polymer material.

6. The dishwasher appliance of claim 1, wherein the transparent component is linear.

7. The dishwasher appliance of claim 1, wherein the transparent component is arcuate.

8. The dishwasher appliance of claim 1, wherein the spot detection assembly further comprises a spacer positioned between the transparent component and the imaging device.

9. The dishwasher appliance of claim 1, further comprising a controller communicatively coupled to the imaging device, the controller having at least one processor with at least one algorithm programmed therein, the at least one algorithm configured to receive an indication from the imaging device of whether the one or more fluid spots are detected on the transparent component or whether the transparent component is spotless.

10. The dishwasher appliance of claim 9, wherein, when the indication from the imaging device indicates the one or more fluid spots are detected on the transparent component, the at least one algorithm is further configured to implement a control action to reduce or eliminate the one or more fluid spots.

11. The dishwasher appliance of claim 10, wherein the control action comprises at least one of a rinse cycle, a wash cycle, a drying cycle, a heating cycle, a draining cycle, a filtering cycle, a drying cycle, or combinations thereof.

12. The dishwasher appliance of claim 9, wherein, when the indication from the imaging device indicates the transparent component is spotless, the at least one algorithm is further configured to end the wash cycle, prevent a rinse aid from being released, or implement a final rinse cycle.

* * * * *